United States Patent [19]

Sato

[11] Patent Number: 4,707,956

[45] Date of Patent: Nov. 24, 1987

[54] EARTHQUAKE INSULATING BUILDING STRUCTURE

[75] Inventor: Takanori Sato, Tokyo, Japan

[73] Assignee: Shimizu Construction Co., Ltd., Tokyo, Japan

[21] Appl. No.: 886,540

[22] Filed: Jul. 16, 1986

[30] Foreign Application Priority Data

| | | | |
|---|---|---|---|
| Aug. 12, 1985 | [JP] | Japan | 60-177066 |
| Aug. 24, 1985 | [JP] | Japan | 60-185994 |
| Aug. 24, 1985 | [JP] | Japan | 60-185995 |

[51] Int. Cl.[4] ..... E02D 27/34

[52] U.S. Cl. ..... 52/167; 52/169.9

[58] Field of Search ..... 52/167, 169.9, 573, 52/722, 725, 727, 728, 299; 405/243, 237

[56] References Cited

U.S. PATENT DOCUMENTS

| | | | |
|---|---|---|---|
| 2,741,910 | 4/1956 | Thornley | 52/169.9 X |
| 3,396,546 | 8/1968 | Pleuger | 405/243 |
| 4,040,260 | 8/1977 | Pryke | 405/243 X |

*Primary Examiner*—Carl D. Friedman

*Attorney, Agent, or Firm*—Scully, Scott, Murphy & Presser

[57] ABSTRACT

An earthquake-insulating building structure including a structure body and a foundation supporting the structure body, the foundation having a plurality of earthquake-insulating piles embedded within the ground, each of the piles including a pile body having upper and lower portions, the upper portion being connected to the structure body, and a cylindrical casing surrounding the upper portion of the pile body so as to form a space between the upper portion of the pile body and the ground.

12 Claims, 11 Drawing Figures

EARTHQUAKE INSULATING BUILDING STRUCTURE

BACKGROUND OF THE INVENTION

This invention relates to an earthquake-insulating structure which is a structure such as a building, bridge, etc., and has an earthquake insulating function against an earthquake attack.

It has been known that a building should be provided with earthquake-insulating devices which insulate it from earthquake vibration. Those devices work generally based on the principle of extending the natural vibration period of the building to where it is far off the vibration period of earthquakes. Otherwise, they work based on the principle of raising the damping coefficient of the structure by using a damper, a dash pot, and the like so as to dissipate earthquake energy.

Those prior devices, however, have a low endurance level since they include the parts made of material such as rubber, oil, iron, and the like which is prone to decomposition by bacteria or to corrosion. Furthermore, they have disadvantages such as insufficient reliability in their friction system against a large relative deformation such as secular change, which develops between the ground and the building.

SUMMARY OF THE INVENTION

Accordingly, it is an object of the present invention to provide an improved earthquake-insulating building structure in which its main section serving to insulate it from earthquakes has excellent endurance against decay and corrosion.

It is another object of the present invention to provide an earthquake-insulating building structure the main section of which has high reliability in resisting secular and other changes.

Another object of the present invention is to provide an earthquake-insulating structure which inhibits transmission of earthquake vibration energy into itself and dampens the transmitted energy, thereby simplifying the structural design of the building.

With these and other objects in view, the present invention provides an earthquake-insulating building structure including a structure body and a foundation supporting the body. The foundation has a plurality of earthquake-insulating piles embedded within the ground. Each of the piles includes a pile body having upper and lower portions, the upper portion being connected to the structure body, and a cylindrical casing surrounding the upper portion of the pile body so that a space is formed between the upper portion of the pile body and the ground.

The above described building structure is based on the "First-Soft-Story Theory" which has been advocated by many researchers. This theory states that it is possible to extend the natural vibration period of a whole building structure by constructing it of piloti construction, i.e., a building construction having its lowest story flexible horizontally. That is, the building structure according to the present invention is of a piloti construction having its foundation flexible horizontally since the upper portion of the pile body is separated from the ground.

A first damper material of asphalt, bentonite slurry, oil, light-weight aggregates, or pumice may be filled in the space between the upper portion of the pile body and the ground. With those fillings, the vibration energy bouncing from the structure body to the pile body during an earthquake is dampened and dissipated so that vibrations in the pile body causing tremors in the structure body are suppressed.

Preferably, each pile body includes a first steel tube, a first concrete core disposed within the first tube, and a first separating layer interposed between the inner face of the first tube and the first core, for separating the core from the inner face of the tube. This construction allows the pile body to have a smaller diameter than a pile body having its steel tube bonded to its core since the former has a higher flexibility and a higher compressive strength than the latter. The less diameter the pile body has, the more its natural vibration period is extended, The lower portion of the pile body is preferably formed to have a larger outer diameter than the upper portion thereof so that the compressive strength thereof is enhanced. In this case, the lower portion should be in firm contact with the surrounding ground.

The structure body may have a plurality of columns, each being connected at its lower end to the pile body. That is to say, what is called footing is not used thereby lowering the cost of the construction.

For further extending the natural vibration period of the building structure, each of the columns of the structure body may include a second steel tube, a second concrete core disposed within the second steel tube, and a second separating layer interposed between the inner face of the second tube and the second core.

The structure body may include a base plate mounted on the pile bodies so as to have no direct contact with the ground. A second damper material of asphalt, bentonite slurry, oil, light-weight aggregate, or pumice may be interposed between said base plate and the ground. The second damper material is stored preferably in a storage reservoir dug in the ground below said base plate.

BRIEF DESCRIPTION OF THE DRAWINGS

Advantages of the present invention will become more apparent upon reference to the following specification and annexed drawings, in which.

DETAILED DESCRIPTION OF THE PREFERRED EMBODIMENTS

Figure 1:
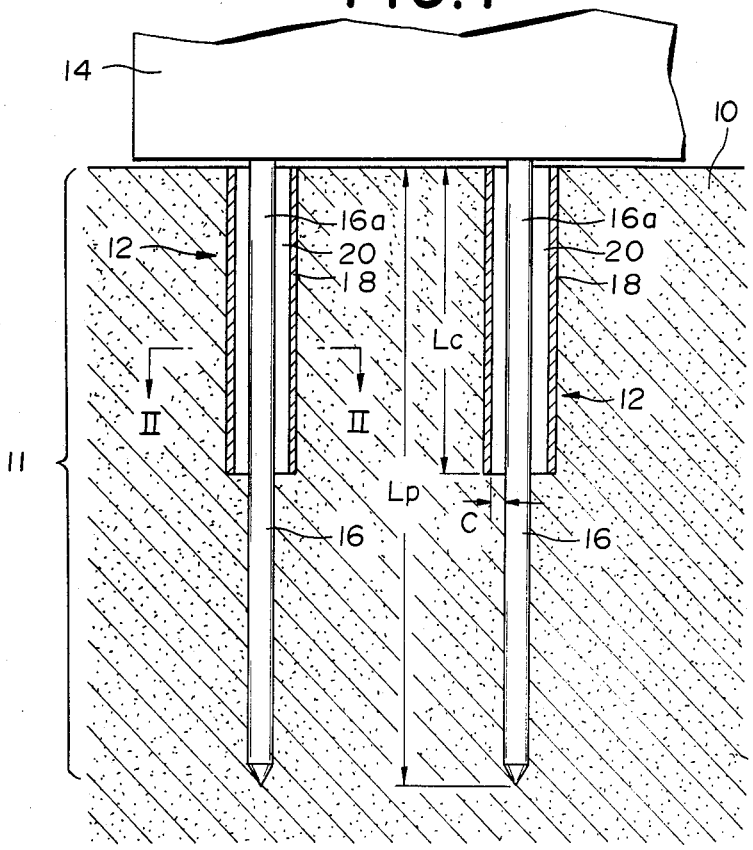
FIG. 1 is a fragmentary front view partly in section of an earthquake-insulating building structure according to the present invention.

Like reference numerals designate corresponding parts throughout the drawings, and descriptions of the corresponding parts are omitted after once given.

Figure 2:
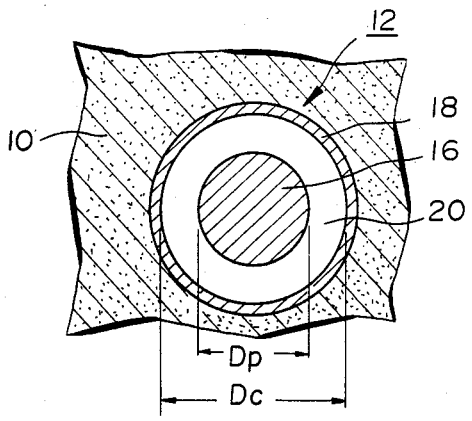
FIG. 2 is a view taken along the line II—II in FIG. 1.

FIG. 1 illustrates a part of an earthquake-insulating structure (a building in this embodiment) according to the present invention. This building has a foundation 11 which includes a plurality of earthquake-insulating piles 12. These piles 12 are embedded vertically within the ground 10. Supported on these piles 12 is a structure body 14 of a rigid reinforced concrete construction. As shown in FIG. 2, each of the piles 12 consists of a pile body 16 and a cylindrical casing 18 concentrically surrounding the upper portion 16*a* of the pile body 16. The pile body 16, such as a steel tube pile filled with concrete, is connected at its upper end to the frame work of the structure body 14. The casing 18, such as a steel pipe, defines a space 20 between its inner face and the pile body 16 so that the upper portion 16*a* of the pile body 16 is separated from the ground 10. The clearance C between the pile body 16 and the casing 18 may be larger than the maximum horizontal displacement of the pile body 16 at a level equal to the upper edge of the casing 18, such a displacement being caused when the pile body 16 vibrates due to an earthquake. For example, the ratio of the inner diameter Dc of the casing 18 over the outer diameter Dp of the pile body 16 is at least 200% when the ratio of the casing length Lc over the pile body length Lp is about 60%.

In this construction, the upper portion 16*a* of each pile body 16 is free from constraint of the ground 10 because of the space 20. In other word, the building is substantially of a piloti construction having a high earthquake-insulating property since it has the foundation 11 of a flexible construction in spite of its structure body 14 having a rigid construction. When an earthquake occurs and the seismic vibration reaches the ground in the vicinity of the building, only a small impact of the seismic force is transmitted into the building since the natural vibration period of the building is extended so as to be far off the vibration period of earthquakes.

Figure 3:
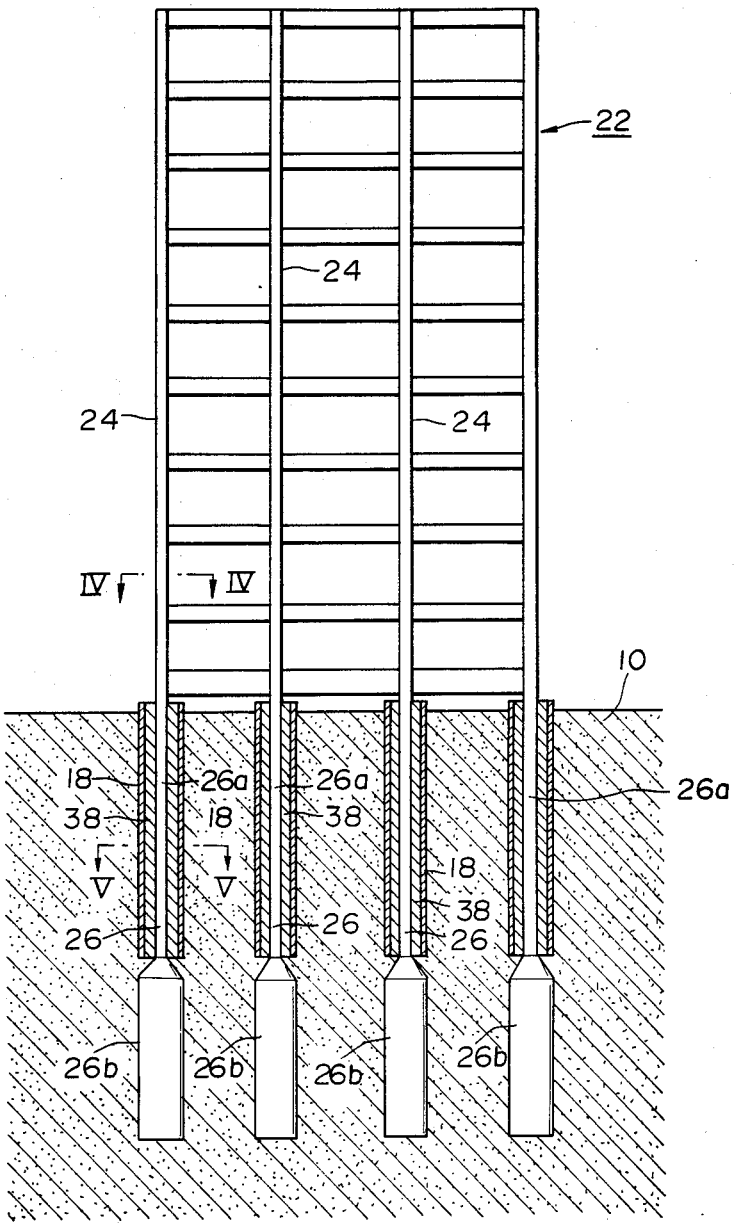
FIG. 3 is a front view partly in section of another embodiment of the present invention.
Figure 4:
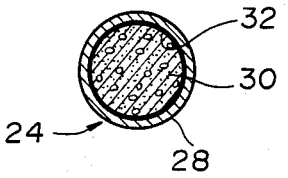
FIG. 4 is a view taken along the line IV—IV in FIG. 3.
Figure 5:
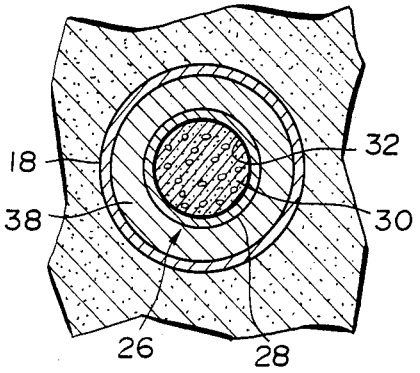
FIG. 5 is a view taken along the line V—V in FIG. 3.
Figure 6:
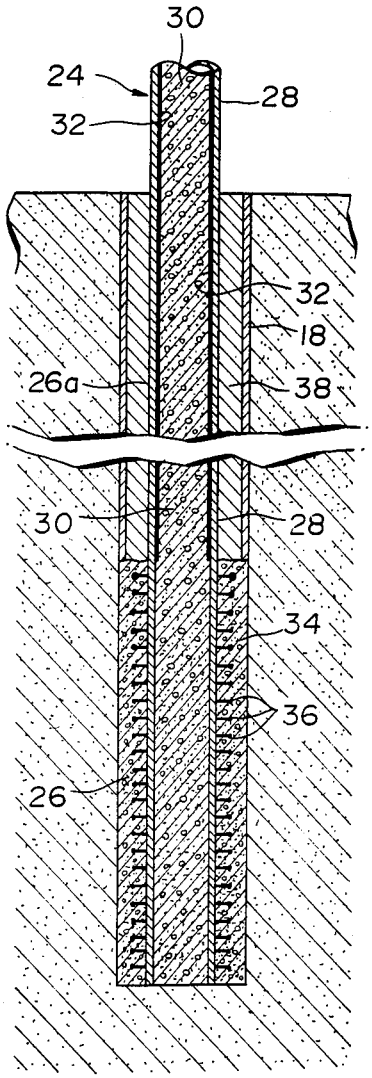
FIG. 6 is an enlarged cross-sectional view of one of the earthquake-insulating piles in FIG. 3.

A reinforced concrete pile may be employed in place of the pile body 16, and a plastic pipe or other pipes made of noncorrosive material may be used as a casing instead of the steel pipe 18, FIGS. 3 to 6 illustrate another embodiment of the present invention, in which a structure body 22 has a plurality of columns 24, each being connected at its lower end to a pile body 26. The column 24 shown in FIGS. 4 and 6 is what I proposed in U.S. Pat. application Ser. No. 835,954 filed on Mar. 4, 1986. The column 24 includes a steel tube 28, a concrete core 30 formed in the steel tube 28 by filling the tube with concrete, and a separating layer 32 interposed between the core 30 and the tube 28. The separating layer 32 may be formed by applying material, such as asphalt, paraffin, grease, oil, and vaseline, on the inner surface of the tube 28 so that the core 30 is separated from the tube 28. The upper portion 26*a* of the pile body 26 is of the same construction as the column 24 shown in FIG. 6.

In the construction described above, the steel tube 28 is axially movable with respect to the core 30 because of the separating layer 32. Therefore, when the core 30 undergoes axial compression, the steel tube 28 follows the core 30 with a much smaller degree of axial strain than a conventional steel tube bonded to its concrete core. That is, the column 24 has a greater compressive strength than conventional columns since the steel tube 28 shows a lateral confinement great enough to resist lateral stress in the core 30. In other words, this construction of the column 24 enables the column 24 to have a smaller diameter than the conventional columns, thus increasing the natural vibration period of the building. Furthermore, the compressive strength of the column 24 and pile body 26 is so high that an economical building construction having no footing between the column 24 and the pile body 26 may be possible. In addition, such building components as the column 24 and the pile body 26 improve the structural flexibility of buildings, because of their excellent flexibility.

As shown in FIG. 3, the lower portion 26*b* of the pile body 26 has a larger outer diameter than its upper portion 26*a* and is in direct contact with the ground 10 so that the pile body 26 attains a further increase in compressive strength. The lower portion 26*b* of the pile body may have its outer diameter increased by a concrete layer 34 coated on the outer face of the steel tube 28. In this case, the lower portion 26*b* of the pile body 26 may have no separating layer between its steel tube and its core. Also, the lower portion 26*b* preferably has a number of anchor bolts 36 welded on the outer face thereof so that the concrete layer 34 is firmly attached thereto.

Figure 7:
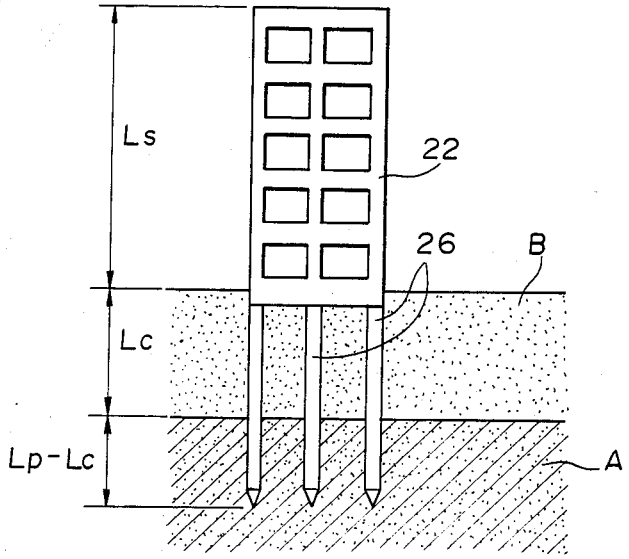
FIG. 7 is a schematic front view of the building structure in FIG. 3.
Figure 8:
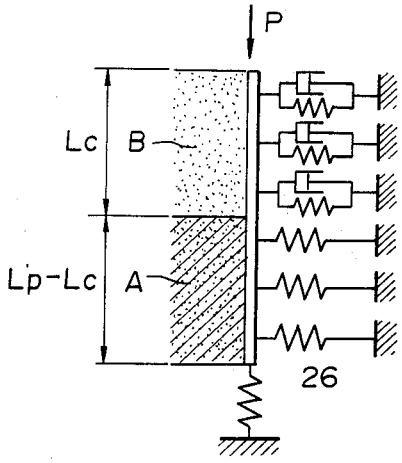
FIG. 8 is a view of a conceptual model of the vibration system composed of the strata, structure body, and the like in FIG. 7.

In this embodiment, a viscous substance 38 soft at normal temperature, such as asphalt, is filled into the space between the pile body 26 and the casing 18. With this arrangement, the building obtains a substantially equal site condition to those built on the ground shown in FIG. 7. This ground consists of a hard stratum A and a soft stratum B deposited on the stratum A. FIG. 8 shows a conceptual model of the vibration system constituted by the pile body 26, both the strata A and B, etc. According to this model in FIG. 8, the natural vibration period $P_1$ of the building in FIG. 7 is defined by the following formula:

$$P_1 = P_2((Ls+Lc)/Ls)^{3/2}$$

where $P_2$ is the natural vibration period of a building built directly on the hard stratum A, Ls is the height of the structure body 22, and Lc is the thickness of the stratum B (in other words, the length of the casing 18). Furthermore, the vibration energy bouncing from the structure body 22 to the pile body 26 during an earthquake is dampened by the soft stratum B (in other words, the viscous substance 38) so that vibrations in the pile body 26 subsequently causing tremors in the structure body 22 are suppressed.

Bentonite slurry or oil may be used as a viscous substance in place of asphalt 38. Alternately, granular material, such as light-weight aggregates and pumice, may be employed in place of the viscous substance. During an earthquake, these granular materials rub one another or break themselves, thereby dissipating the vibration energy.

Figure 9:
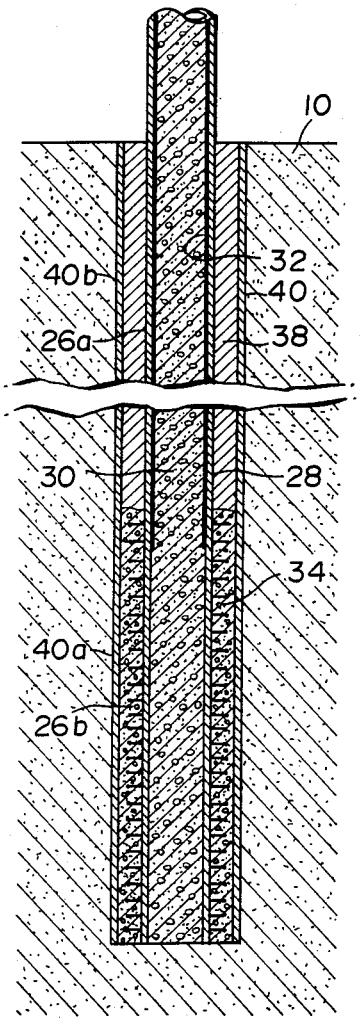
FIG. 9 is a cross-sectional view of a modified form of the earthquake-insulating pile in FIG. 6.

FIG. 9 illustrates a modified form of the earthquake-insulating pile in FIG. 6, in which a cylindrical casing 40 has a lower end section 40*a* extending downward to enclose the lower portion 26*b* of the pile body 26. The lower end section 40*a* is firmly bonded at its inner face to the lower portion 26*b*, and the outer surface 40*b* of the casing 40 is in firm contact with the surrounding ground 10. Such a casing 40 may be set in the ground 10 by driving it vertically into the ground and then by hollowing its inside. Otherwise, it may be set by boring a deep hole in the ground 10 and sinking the casing 40 in the hole, alternately, by driving the casing 40 into the ground inch by inch while a hollow is being dug in the ground adjacent to the lower end of the casing 40. In any of the above cases, the casing 40 must be embedded within the ground with its outer surface in direct contact with the ground 10 so that a large frictional force is exerted between the casing 40 and the ground 10 during an earthquake.

In this modification, the casing 40 is substantially a part of the pile body 26, thus the pile body 26 has a larger surface area supported by the ground 10 than the pile body in FIG. 6. Accordingly, the pile body 26 achieves both excellent vertical and horizontal load bearing capacities as well as pull-out resistance, these increasing relative to the frictional force exerted between the pile body and the ground, even if the ground 10 is not firm. If a pile in which the casing is not bonded to the pile body is constructed in weak ground, the pile body could break the surrounding ground during an earthquake because of lack of frictional force between the pile body and the ground. Also, the pile of this modification may enable the pile body 26 to be shorter than the pile body in FIG. 6, which facilitates setting the pile body 26 in the ground.

The casing 40 must be designed to have such mechanical strength as to support the pile body 26. The inner surface of the steel tube 28 may be roughened at its lower portion so that the core 30 is firmly bonded to the steel tube 28 and thus causing the axial force from the core 30 to transfer via steel tube 28 to the concrete layer 34 and subsequently to the ground 10. Concrete which is used for forming the upper portion **26*a* of the pile body 26 may be higher in compressive strength than that used for forming its lower portion 26*b* since the former concrete supports more compression per unit area than the latter. In other words, by using concrete of different types for the upper portion 26*a* and the lower portion 26*b***, the pile can be economically constructed.

Figure 10:
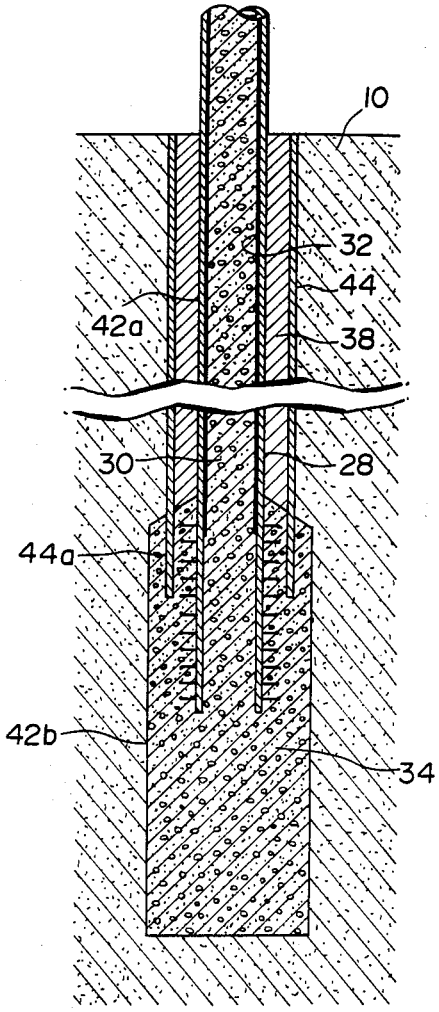
FIG. 10 is a cross-sectional view of another modified form of the earthquake-insulating pile in FIG. 6.

FIG. 10 shows another modified form of the pile in FIG. 6, in which the lower portion **42*b* of a pile body 42 are designed to have a larger outer diameter than a casing 44, and the lower end section 44*a* of the casing 44 is embedded within the lower portion 42*b*. A lower half of the lower portion 42*b* does not include the steel tube 28** in this modification.

Figure 11:
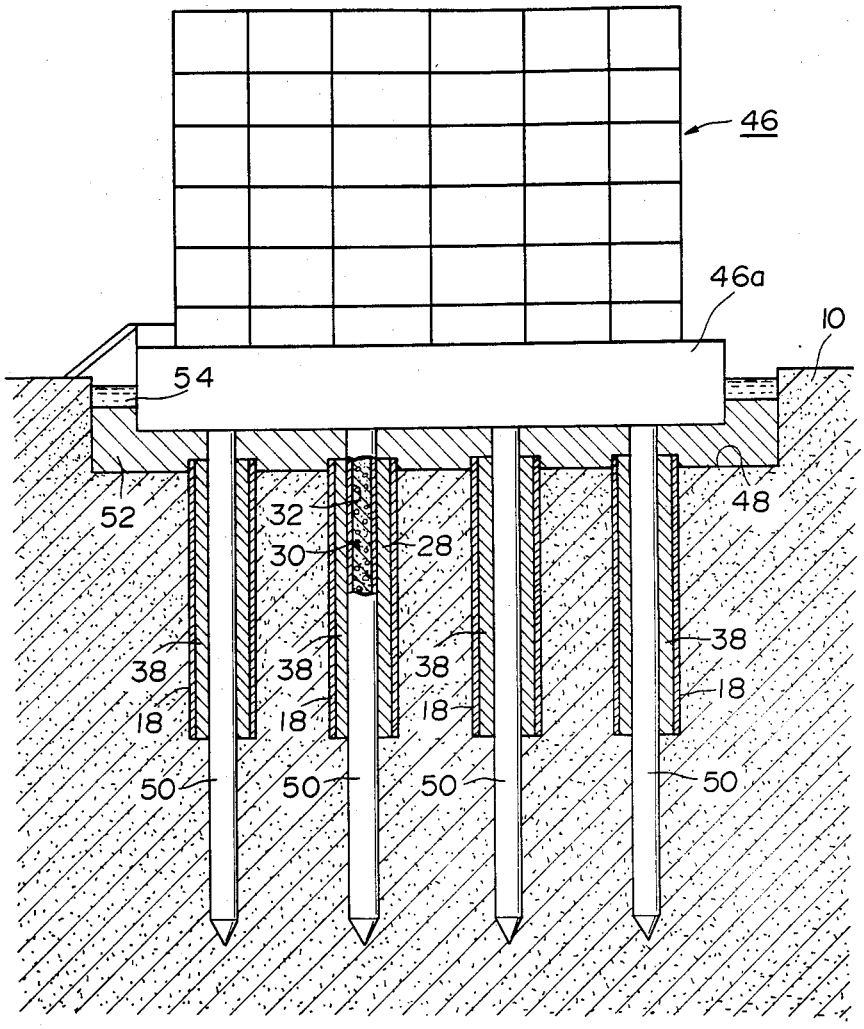
FIG. 11 is a front view partly in section of still another embodiment of the present invention.

FIG. 11 shows still another embodiment of the present invention, in which the ground 10 below a structure body 46 is dug down to the level one step lower than the surrounding ground level to form a storage reservoir 48. The reservoir 48 is designed to have its capacity large enough to hold the base plate **46*a* which constitutes the bottom part of the structure body 46. A plurality of pile bodies 50 are embedded within the ground 10 with their upper ends projecting from the bottom of the reservoir 48. Each of the pile bodies 50 in this embodiment is a concrete filled steel tube of equal diameter lengthwise, provided in its upper portion with the separating layer 32. These pile bodies 50 are welded at their upper ends to the framework of the base plate 46*a* thereby supporting the structure body 46. In other words, the base plate 46*a* is placed in the reservoir 48 while it has no contact with the ground 10, allowing the base plate to be movable horizontally. A viscous substance 52 such as asphalt, bentonite slurry and oil, or a granular material such as light-weight aggregate and pumice may be stored in the reservoir 48 so as to fill the space between the base plate 46*a* and the ground 10. In the case of an inflammable viscous substance like asphalt being used to fill the reservoir 48, water 54** should be deposited over the inflammable substance to fireproof it.

The structure body 46 in this construction is separated from the ground 10, hence the flexibility of the building foundation is further enhanced. Also, the viscous substance 52 dampens and dissipates that part of seismic vibration energy which has been transmitted into the pile body 50 subsequently suppressing tremors in the structure body 46.

It will be understood that although preferred embodiments of the present invention have been shown and described, various modifications thereof will be apparent to those skilled in the art, and, accordingly, the scope of the present invention should be defined only by the appended claims and equivalents thereof.

What is claimed is:

1. An earthquake-insulating building structure including a structure body and a foundation supporting said structure body, said foundation having a plurality of earthquake-insulating piles embedded within the ground, each of said piles comprising:

a pile body having upper and lower portions, the upper portion being connected to said structure body; and a cylindrical casing embedded in the ground having an inner face concentrically surrounding the upper portion of said pile body so as to form a space between said upper portion of the pile body and said inner face of the casing, said space retaining the upper portion of the pile body to be free from constraint of the ground so that said building structure has a natural vibration period thereof substantially longer than the vibration period of general earthquakes.

2. An earthquake-insulating building structure as recited in claim 1, further comprising a first damper member filled within said space, for dampening seismic vibration energy bouncing from said structure body to said pile body during an earthquake.

3. An earthquake-insulating building structure as recited in claim 2, wherein said first damper member is made of a non-rigid substance selected from the group consisting of asphalt, bentonite slurry, oil, light-weight aggregate, and pumice.

4. An earthquake-insulating building structure as recited in claim 1, wherein said pile body comprises a first steel tube having an inner face, a first concrete core disposed within said first steel tube, and a first separating layer interposed between the inner face of said first tube and said first core for separating the first core from the inner face of the first tube so that the first tube is not bonded to the first core.

5. An earthquake-insulating building structure as recited in claim 4, wherein said lower portion of the pile body has a larger outer diameter than said upper portion thereof, said lower portion being in firm contact with the surrounding ground.

6. An earthquake-insulating building structure as recited in claim 4, wherein said structure body includes a plurality of columns each having a lower end, said upper portion of said pile body being connected to the lower end of each of said columns.

7. An earthquake-insulating building structure as recited in claim 6, wherein each of said columns of the structure body comprises a second steel tube having an inner face, a second concrete core disposed within said second steel tube, and a second separating layer interposed between the inner face of said second tube and said second core for separating the second core from the inner face of the second tube so that the second tube is not bonded to the second core.

8. An earthquake-insulating building structure as recited in claim 4, wherein said structure body includes a base plate having no contact with the ground, said base plate being movable horizontally under external force, said upper portion of said pile body being connected to the base plate.

9. An earthquake-insulating building structure as recited in claim 8, further comprising a second damper member interposed between said base plate and the ground, for dampening seismic vibration energy transmitted into said pile body during an earthquake.

10. An earthquake-insulating building structure as recited in claim 9, further comprising a storage reservoir dug in the ground below said base plate, said reservoir being large enough to hold said base plate, said second damper member being made of a non-rigid substance selected from the group consisting of asphalt, bentonite slurry, oil, light-weight aggregate, and pumice, said second member being stored in said reservoir.

11. An earthquake-insulating building structure as recited in claim 1, wherein said cylindrical casing has an outer surface in firm contact with the surrounding ground, and wherein said casing has a lower end section joined to the lower portion of said pile body.

12. An earthquake-insulating building structure as recited in claim 11, wherein said cylindrical casing has a diameter less than or equal to the diameter of said lower portion of said pile body.

* * * * *